United States Patent [19]

Vielhauer

[11] Patent Number: 4,911,658

[45] Date of Patent: Mar. 27, 1990

[54] MOTOR-VEHICLE LAMP SOCKET

[75] Inventor: Werner Vielhauer, Kierspe, Fed. Rep. of Germany

[73] Assignee: Hugo Schnippering GmbH & Co. KG, Kierspe, Fed. Rep. of Germany

[21] Appl. No.: 345,620

[22] Filed: May 1, 1989

[30] Foreign Application Priority Data

May 18, 1988 [DE] Fed. Rep. of Germany ..... 3816909

[51] Int. Cl.[4] ..... H01R 17/06

[52] U.S. Cl. ..... 439/544; 439/567

[58] Field of Search ..... 439/544–549, 439/552, 553, 554, 556, 559, 562, 567, 572

[56] References Cited

U.S. PATENT DOCUMENTS 4,119,359 10/1978 Schultz ..... 439/567

4,451,103 5/1984 Buresh et al. ..... 439/544

*Primary Examiner*—Joseph H. McGlynn

*Attorney, Agent, or Firm*—Herbert Dubno; Andrew Wilford

[57] ABSTRACT

A socket adapted to fit through a hole in a panel and serving to hold a light bulb and connect same to a multiconductor plug comprises a one-piece L-shaped housing formed of dielectric material and having a generally circular-section tubular socket leg and a tubular contact leg. The legs are centered on respective axes and completely laterally imperforate and closed and together they form a continuous L-shaped passage. A dielectric insert sleeve snugly received in the socket leg is provided with formations complementary to a base of a bulb to be mounted in the socket. A dielectric plug fitted in and completely blocking the contact leg is formed with a pair of adjacent throughgoing slits receiving respective conductive contacts strips each having an outer end exposed outside the plug in the contact leg and inner ends projecting into the socket leg and engageable with the base of the bulb therein.

12 Claims, 1 Drawing Sheet

FIG.5
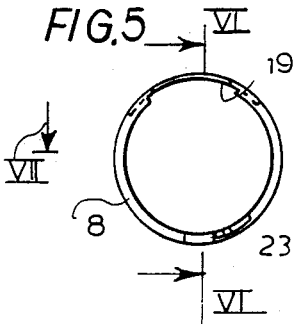
FIG.6
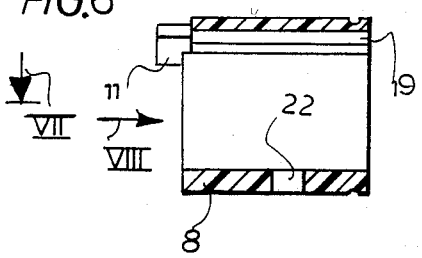
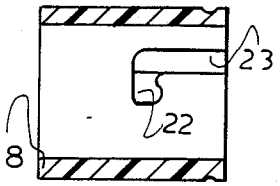
FIG.7
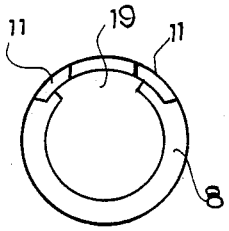
FIG.8
FIG.10
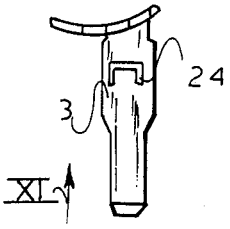
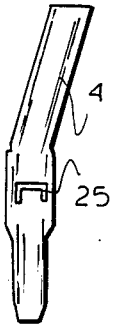
FIG.9
FIG.11
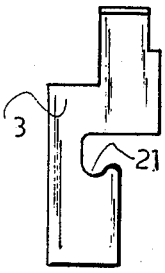
FIG.12
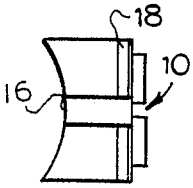

MOTOR-VEHICLE LAMP SOCKET

FIELD OF THE INVENTION

The present invention relates to a lamp or light-bulb socket. More particularly this invention concerns such a socket for use in a motor vehicle.

BACKGROUND OF THE INVENTION

A standard lamp socket for use in a motor-vehicle taillight or the like comprises a housing formed of insulating material and having one end open and adapted to receive the base of the lamp and an opposite end in which the contacts connected to the lamp are exposed. Typically the housing is L-shaped in order to reduce installation height, as the old-style straight units took up too much room, and the contacts are set up to interfit with a two-conductor plug. The bulb leg of the socket is fitted through a hole in a panel of the vehicle and sealed.

In order to assemble the unit a side of the plug leg of the housing is formed with a flap or left open so that the contacts can be fitted to this leg from inside. Once installed the lateral opening is plugged or the flap is closed and sealed. Similarly in order to accommodate what is normally a bayonet-mount bulb, the sides of the bulb leg of the housing must be punched and these holes subsequently filled also.

Such a socket therefore is inherently weakened by the several openings formed in it and subsequently closed. In addition the formation and closing of these openings substantially increases fabrication costs, and when not done properly the socket is not watertight, which it must be when used in a motor-vehicle taillight or the like.

OBJECTS OF THE INVENTION

It is therefore an object of the present invention to provide an improved socket for a bulb.

Another object is the provision of such an improved socket for a bulb which overcomes the above-given disadvantages, that is which is of simple construction yet which is easy to fabricate.

A further object is to provide such a socket which, when assembled, is certainly leakproof and very robust.

SUMMARY OF THE INVENTION

A socket adapted to fit through a hole in a panel and serving to hold a light bulb and connect same to a multiconductor plug comprises according to this invention a one-piece L-shaped housing formed of dielectric material and having a generally circular-section tubular socket leg and a tubular contact leg. The legs are centered on respective axes and completely laterally imperforate and closed and together they form a continuous L-shaped passage. A dielectric insert sleeve snugly received in the socket leg is provided with formations complementary to a base of a bulb to be mounted in the socket. A dielectric plug fitted in and completely blocking the contact leg is formed with a pair of adjacent throughgoing slits tightly receiving respective conductive contacts strips each having an outer end exposed outside the plug in the contact leg and inner ends projecting into the socket leg and engageable with the base of the bulb therein.

Thus the system of this invention comprises only six parts that need have no holes or flaps that need to be closed and sealed after assembly. The device therefore can be counted on to be very strong and completely waterproof. In addition it can be assembled without the use of seals, mastics, adhesives, or even tools.

According to a feature of the invention the sleeve is centered on an axis, coaxial with the bulb leg, and is formed with a pair of axial extensions. The housing has a wall forming a floor of the bulb leg and a side extension of the plug leg and itself formed with respective recesses receiving the extensions. These extensions can be longer than the depth of the recesses and they can flank the contacts to accommodate them in the socket.

In accordance with a further feature of this invention the sleeve and the bulb leg are formed with interengageable formations that fit together only in a fully seated position of the sleeve. These formations can be a radially open groove and a radially projecting ridge engageable therein.

Similarly according to the invention the plug leg is of noncircular section the plug and plug leg extend along a plug axis and are formed with axially extending interengaging formations only permitting the plug to fit in one angular position in the plug leg. These formations include an axially extending and radially projecting ridge and a radially open groove receiving the ridge. This ridge can also serve to ensure proper polarity of the plug fitted to the plug leg in use. In addition the plug and the plug leg are formed with interengageable formations that fit together only in a fully seated position of the plug in the plug leg. These formations are a radially open groove and a radially projecting ridge engageable therein.

The sleeve itself is formed with an inwardly open recess that may be undercut and one of the contact strips is a ground contact having an inner leg lying and even captured in this recess. What is more one of the contacts has an inner leg adapted to lie radially against the sleeve and an outer leg extending through the plug. This outer leg has a length shorter than the inside diameter of the bulb leg so that the device can be assembled easily.

DESCRIPTION OF THE DRAWING

The above and other objects, features, and advantages will become more readily apparent from the following, reference being made to the accompanying drawing in which:

FIG. 5 is an end view of the insert sleeve of this invention;

FIGS. 6 and 7 are axial sections taken respectively along lines VI—VI and VII—VII of FIG. 5;

FIG. 8 is an end view taken in the direction of arrow VII of FIG. 6;

FIGS. 9 and 10 are side views of the contact strips of this invention;

FIG. 11 is a view taken in the direction of arrow XI of FIG. 10; and

FIG. 12 is a large-scale side view of the contact plug of this invention.

SPECIFIC DESCRIPTION

Figure 1:
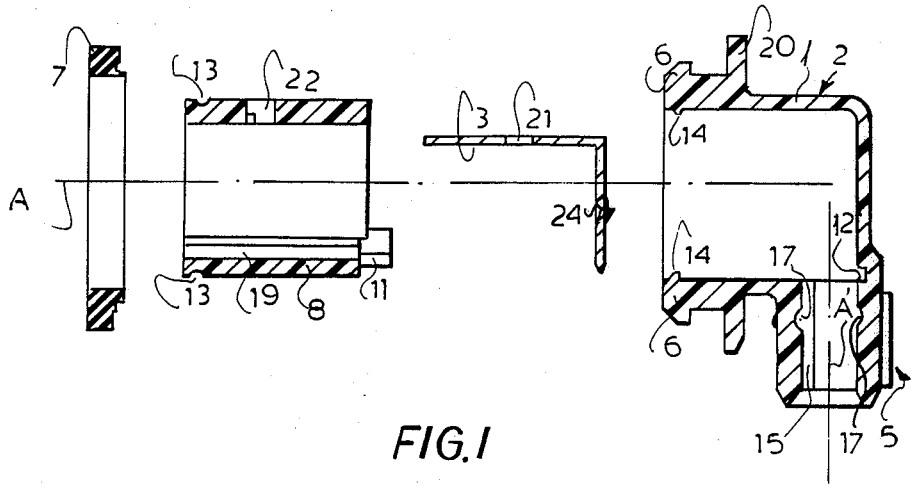
FIG. 1 is an exploded sectional view of the socket according to this invention.
Figure 4:
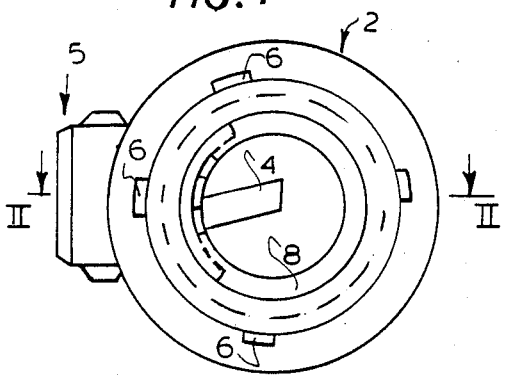
FIGS. 3 and 4 are side and end views taken respectively in the direction of arrow III and IV of FIG. 3, the panel being left out for clarity of view.
Figure 2:
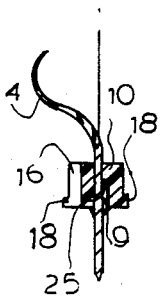
FIG. 2 is a sectional view through the assembled socket shown installed in a panel.
Figure 2:
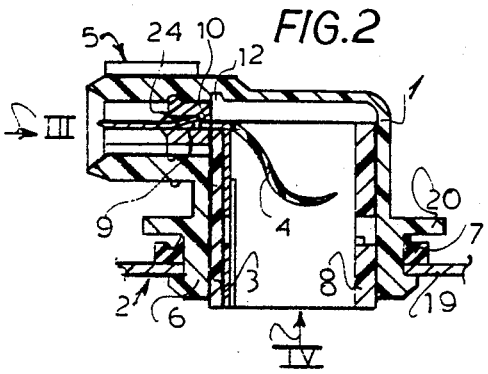
Figure 3:
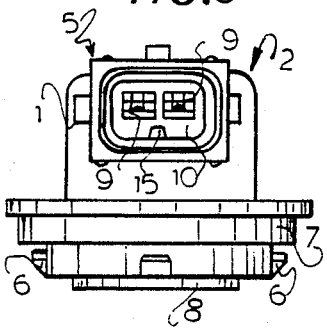

As seen in FIGS. 1 through 4 the socket according to this invention comprises a one-piece polyamide shell or housing 1 of L-shape having a circular section leg 2 centered on a bulb axis A and an oval-section leg 5 centered on a plug axis A' perpendicular to the axis A. In order to fit in an opening of a panel shown at 19 in FIG. 2 only the outer end of the bulb leg 2 is formed with four tabs 6 that engaged in unillustrated notches in the opening of this panel 19 so that after insertion the socket shell 1 can be twisted bayonet-fashion to secure it in place. An elastomeric seal ring 7 engages between the back of the panel 19 and a flange 20 extending radially from the leg 2 to make the fit watertight.

The socket also comprises an L-shaped ground contact strip 3 and a base-tip contact 4 having identical outer legs that fit through respective slits 9 formed in a polyamide plug 10 that fits complementarily in the passage of the plug leg 5. In order to ensure a solid interfit of this plug 10 in the leg 5 it has on its outer end a radially outwardly projecting ridge 18 and the leg 5 has a radially inwardly open complementary groove 17 that snap-fit together when the plug 10 is pushed axially into the end of the leg 5, from the bottom as seen in FIG. 1. In addition one side of the leg 5 is formed with an axial rib 15 that interfits with an axial groove 16 (see also FIG. 12) of the plug 10 to prevent same from being installed backward.

The leg 2 has a cylindrical inner surface that, in addition to being radially imperforate like the leg 5, is formed with a radially inwardly projecting ridge 5 but that is otherwise smooth. An insert sleeve 8 shown in some detail in FIGS. 5 through 8 has a complementary outer surface and is formed with a radially outwardly open groove 3 into which the rib 14 can snap. In addition this sleeve 8 has an inner end (to the right in FIG. 1) formed with two extension tabs 11 that flank an axially extending and inwardly open groove 19. The tabs 11 fit in recesses 12 that flank the inner end of the leg 5 and that are of complementary shape but substantially shorter depth than the length of these tabs 11. Thus the tabs 11 fit in the seats 12 and hold the inner end of the sleeve 8 off the end of the leg 2. The inner end of the ground strip 3 fits in the groove 19 and is formed with a cutout 21 (see FIG. 11) for one of the bayonet pins on a bulb to be fitted in the leg 2, the opposite side of the sleeve 8 being formed with a J-shaped 23 groove ending in a hole 22 that receive the other bayonet pin of the unillustrated bulb.

The outer legs of both contact strips 3 and 4 are formed with laterally projecting barbs or tabs 24 and 25 that engage in lateral enlargements of the slits 9 to block extraction of these contact strips 3 and 4 once they are pushed into the slits 9 of the insert 10.

The above-described assembly can be put together entirely without the use of adhesives and, once assembled, will be a watertight and robust unit.

To start with the base contact 4 is pushed from the inside through the plug 10 until its tab 25 locks in place. Then this plug 10 is pushed into the leg 5 until the ridge 16 snaps tightly into the groove 17, thereby solidly locking it in place.

The other contact 3 is then fitted into the leg 2, to which end its outer leg is shorter than the diameter of this leg 2, and the outer leg is pushed out through the respective slit 9 until its tab 24 snaps into place, locking it in also.

The insert or liner sleeve 8 is then pushed axially into the leg 2, with the inner leg of the contact 3 sliding along the undercut groove 19, until the tabs 11 seat in the recesses 12 and the ridge 14 snaps into the groove 13. The ring 7 is then stretched over the tabs 6 until it rests on the flange 20, and the assembly is complete.

Since both legs 2 and 5 are laterally completely closed and imperforate the device is very watertight. In addition the plug 9 is such a tight fit that it blocks flow through the passage formed by the two legs 2 and 5. Even though the system is very robust and watertight, it comprises only six separate parts of which the plastic ones—the shell 1, seal 7, sleeve 8, and plug 9—can be injection molded and the metal ones—the contacts 3 and 4—can be stamped. The system has no holes that need to be plugged after assembly and no flaps or the like that need to be closed and sealed, making the finished product simple in the extreme.

I claim:

1. A socket adapted to fit through a hole in a panel and serving to hold a light bulb and connect same to a multiconductor plug, the socket comprising:

a one-piece L-shaped housing formed of dielectric material and having a generally circular-section tubular socket leg and a tubular contact leg, the legs being centered on respective axes and completely laterally imperforate and closed, the legs together forming a continuous L-shaped passage;

a dielectric insert sleeve snugly received in the socket leg and provided with formations complementary to a base of a bulb to be mounted in the socket;

a dielectric plug fitted in and completely blocking the contact leg and formed with a pair of adjacent throughgoing slits; and respective conductive contacts strips received in the slits and each having an outer end exposed outside the plug in the contact leg and inner ends projecting into the socket leg and engageable with the base of the bulb therein.

2. The socket defined in claim 1 wherein the sleeve is centered on an axis, coaxial with the bulb leg, and is formed with a pair of axial extensions, the housing having a wall forming a floor of the bulb leg and a side extension of the plug leg and itself formed with respective recesses receiving the extensions.

3. The socket defined in claim 1 wherein the sleeve and the bulb leg are formed with interengageable formations that fit together only in a fully seated position of the sleeve.

4. The socket defined in claim 3 wherein the formations include a radially open groove and a radially projecting ridge engageable therein.

5. The socket defined in claim 1 wherein the plug leg is of noncircular section the plug and plug leg extend along a plug axis and are formed with axially extending interengaging formations only permitting the plug to fit in one angular position in the plug leg.

6. The socket defined in claim 5 wherein the formations include an axially extending and radially projecting ridge and a radially open groove receiving the ridge.

7. The socket defined in claim 1 wherein the plug and the plug leg are formed with interengageable formations that fit together only in a fully seated position of the plug in the plug leg.

8. The socket defined in claim 7 wherein the formations include a radially open groove and a radially projecting ridge engageable therein.

9. The socket defined in claim 1 wherein the sleeve is formed with an inwardly open recess and one of the contact strips is a ground contact having an inner leg lying in the recess.

10. The socket defined in claim 1 wherein the sleeve is centered on an axis, coaxial with the bulb leg, and is formed with a pair of axial extensions flanking the contacts, the housing having a wall forming a floor of the bulb leg and a side extension of the plug leg and itself formed with respective recesses receiving the extensions and of a depth shorter than the axial length of the extensions.

11. The socket defined in claim 1 wherein the sleeve is formed with an inwardly open undercut recess and one of the contact strips is a ground contact having an inner leg captured in the recess.

12. The socket defined in claim 1 wherein one of the contacts has an inner leg adapted to lie radially against the sleeve and an outer leg extending through the plug, the outer leg having a length shorter than the inside diameter of the bulb leg.

* * * * *